United States Patent [19]

Heider et al.

[11] 4,087,667

[45] May 2, 1978

[54] DOUBLE-THROW CONTACT

[75] Inventors: Wolfgang Heider, Lengries; Hans Heiland, Geretsried; Wolfgang Adalbert Schroetter, Unterhaching, all of Germany

[73] Assignee: Bunker Ramo Corporation, Oak Brook, Ill.

[21] Appl. No.: 650,192

[22] Filed: Jan. 19, 1976

[30] Foreign Application Priority Data

Jan. 20, 1975 Germany ..... 2502078

[51] Int. Cl.[2] ..... H01H 1/50

[52] U.S. Cl. ..... 200/245; 200/247; 335/192; 335/200

[58] Field of Search ..... 200/245–247, 200/281, 283, 284; 335/185, 187, 192, 193, 196, 200, 128

[56] References Cited

U.S. PATENT DOCUMENTS

| | | | |
|---|---|---|---|
| 2,616,993 | 11/1952 | Koehler | 200/283 X |
| 3,020,365 | 2/1962 | Neeman | 200/245 X |
| 3,146,327 | 8/1964 | Ohki et al. | 200/246 X |
| 3,165,607 | 1/1965 | Hogan | 335/187 |
| 3,750,060 | 7/1973 | Pfenning | 200/283 X |
| 3,819,896 | 6/1974 | Aida | 200/283 |
| 3,885,115 | 5/1975 | Schrotter | 200/245 |

*Primary Examiner*—Edward A. Miller
*Attorney, Agent, or Firm*—William Lohff; F. M. Arbuckle

[57] ABSTRACT

A double-throw contact assembly, particularly for relay switches, or push button switches of the non-locking type, having a break contact, a make contact, and a pair of flexible contact arms associated therewith. Each contact arm is fixed adjacent one of its ends at a clamp point and has a free end movable into and out of contact with one of the break and make contacts. In their relaxed state, the arms converge at the clamp point from a bend intermediate the free end and the clamp point, thereby to define two linear portions or segments for each arm, a first straight segment for each arm extending from the clamp point to the bend, and a second straight segment for each arm extending from the bend to the free end of the arm.

20 Claims, 5 Drawing Figures

DOUBLE-THROW CONTACT

BACKGROUND OF THE INVENTION

1. Field of the Invention

The field of art to which the invention pertains includes the field of miniature relays and electrical switches wherein reliable contact without substantial contact bounce is important.

2. Description of the Prior Art

Double-throw contact assemblies for relays are known which have the shape of a simple straight leaf spring and which are moved by means of an insulating member, fixed to the armature of the device, from a break to a make contact and back again so that the springs are elastically deformed in each end position. However, when contact is made, it is done so in a more or less uncontrollable manner, dependent upon many factors, e.g., the tolerances of the armature dimensions, the relative positions of armature with the break and make contacts, the size of the contact points, etc. Accordingly, for such known contact assemblies, an extensive adjustment procedure is necessary in order to provide a contact source sufficient for insuring a good contact resistance. A further disadvantage of such double-throw contacts resides in the fact that, in the contacting position, the armature or actuator member is in engagement with the flexible arm, thereby permitting undesirable oscillations and bouncing or chattering of the armature to adversely affect the point of contact.

Double-throw contact assemblies are already known which are provided with two mechanically separated leaf springs for engaging the make or break contact points, where the above-mentioned disadvantage of the transferring of possible oscillations and chattering from the armature to the contact arm in the make position is diminished. However, even for such double-throw contacts, there remains the disadvantage that the respective contact arm in the make position is being under pressure from the armature, elastically deformed in a rather uncontrollable manner so that its adjustment in the make position is necessary.

A further mechanical disadvantage of the two prior art types of double-throw contact assemblies discussed above resides in the fact that, in most cases, the contact arms, that is the leaf springs, are symmetrically slitted. While this results in the advantage that for each contact side associated with a contact arm, two contact points are provided which substantially increases the probability of a safe and reliable contact, the disadvantage of such an arrangement is that the determination of an exact spring characteristic (force-distance relationship) is made exceptionally difficult because of the different cross sections of the springs which must be taken into account over the entire length of the spring. Furthermore, the two tongues of a symmetrically slitted leaf spring will have the same oscillation and chattering behavior, so that with respect to this property, no improvement is made.

A particular difficulty arises in the manufacture and adjustment of double-throw contact assemblies for miniaturized relays of the type disclosed in German Patent No. 1,639,417. In this known relay, the ends of the contact springs are bent at an angle so that they can serve as soldering terminals for printed circuit boards. Considering that the contact assemblies are disposed, for reasons of limitation of space and for improved protection, within the coil form of the winding of the relay, it is clear that all points of contact for the assembly must extend from the two ends of the coil and must be bent either before or after their installation. This has the disadvantage that the contacts, if they are bent before installation must be mounted on separate insulating bodies so that they can be introduced into the coil from both sides thereof. This in turn means that the contacts cannot be pre-aligned.

On the other hand, if all of the contact arms are secured to a single insulating body, then the contact alignment can be precisely made before installation within the center of the relay coil. However, this requires that some of the contact members be bent after the assembly has been introduced into the coil. Thus, a serious trade-off results, since in order to insure proper registration and reliable contact, the flexible contact arm must be made of a springy material which cannot be easily bent, and if made of a material which is easily bendable, does not possess the necessary spring qualities of a reliable leaf spring.

A further disadvantage, particularly evident in miniaturized relays, is the determination of the precise force acting to close a contact which will result in a preferred elastic deformation of the springy contact material. This problem becomes more apparent when one considers that the available space within the relay coil for positioning the make contact, the break contact, and the throw contact, measured in the direction of movement of the throw contact, is typically only about 1.6 mm. Thus, in order to guarantee a fail-safe function of such a relay, it is necessary that the contact forces are no less than certain minimum values in view of the resulting desirable contact resistances.

The small size of the contacts, the magnitude of the contacting forces, as well as the necessary frequency of switching, makes it necessary to utilize materials having the maximum possible hardness for such contacts. Such materials, once they have been hardened or heat treated during their manufacture, can withstand only a very small amount of deformation, which limits the ability to install the assembly in the relay coil core prior to bending the contacts to form terminals.

Another factor that enters into attempting to guarantee a predetermined amount of elastic deformation of the contact arm as contact is made, is that, as the cross section of the spring becomes smaller, the thickness tolerance of the manufacturing process (for example, about 0.01 mm) as well as the edge effect in the hardening zones created by cutting edges, have a relatively larger influence. This means, for example, that a tolerance of 0.01 mm and a nominal thickness of such a spring of 0.1mm causes a change of contact force of approximately 30%.

Already known in the prior art is a type of double-throw contact assembly of the above-described kind in which the two contact arms in their relaxed state are bent away from one another, while in the tensioned state and contacting the make contact, they essentially have a straight form.

Such a form of the arms of a double-throw contact assembly has the advantage that the spring characteristic, that is the force-distance relationship, is known. Accordingly the contact forces can be exactly predetermined. Thus, the elastic deformation is precisely controllable in the critical state when the contact is made so that there is no necessity for a time consuming, and thereby expensive, final adjustment. For example, the contact forces can be determined by a single reference measurement and can be later controlled after the contact has been installed, by simple manual adjustments while visibly observing the assembly to insure that the arm making contact has a straight shape. Due to the linearity of the contact arm in the tensioned state, the point where the armature engages the flexible contact arm by means of an actuator element at the instant of contact interruption is more exactly predetermined. This makes possible the optimum positioning of the armature return spring as well as the magnetic flux characteristics of the winding of the relay.

An additional difficulty involved in the manufacture of such double-throw contact assemblies is, however, that, due to the uncontrollable variation of thickness tolerances and inhomogeneity of the spring source material during the manufacture of a large number of contact springs, a uniform stamping or bending of the contact arms by a bending tool can only be achieved with relative difficulty or with relatively high costs. In view of the extreme demands which are made on the flexible contact arm, it is generally not possible to dispense with an adjustment procedure in the manufacturing process of the assembly.

SUMMARY OF THE INVENTION

It is an object of the present invention to provide a double-throw contact assembly devoid of the above-mentioned disadvantages and which can be manufactured cheaply and efficiently. This object is realized by the provision of a pair of flexible arms for the assembly, which arms in their relaxed state each comprise two linear portions forming an angle with each other at a bend intermediate the ends of the arms.

In this form, the double-throw contact can be manufactured efficiently and simply, since the two straight sections can be easily stamped by carrying out the stamping operation at two unique stamping places, i.e., at the clamp point and at the bend between each straight segment. In this manner, differential and broadly scattered hardness distortion due to hardening are avoided. Additionally, a double throw contact of this type has the particular advantage that the contact arm in the tensioned state forms a straight line between the point of engagement with the relay armature and the point of contact with the make and break contacts, thereby permitting an exact alignment of the contact points optically.

Preferably, the two flexible contact arms are bent in opposite directions in their relaxed state, and symmetrical about a line of symmetry longitudinally of the arms. In this arrangement, the two contact arms advantageously form substantially a straight line in the critical area between the armature point of engagement and the electrical contact points in the tensioned state, so that the two straight lines defined by the end segments of the contact arms are approximately parallel to the line of symmetry. Additionally, in this arrangement, isolation of any vibratory effects of the actuator number is eliminated by insuring that a small space is provided between the parallel contact arms when either of the arms are in contact with its adjacent make or break contact member. The space so provided insures that the contact arm making electrical contact with the make or break contact is not physically linked with the armature.

It has been found to be practical to slit the contact arms so as to form individual tongues, from their free ends to the clamping point. Thus, although a small reduction in spring force is realized, an offsetting advantage is that the elastic deformation of a constant cross-section taken along the free length of the spring for each tongue can be predetermined more precisely.

It has been also found advantageous to situate the clamping points of the two tongues of a contact assembly staggered with respect to each other in the longitudinal direction of the contact arms. In this manner, the tongues have different spring characteristics and thereby a different behavior for possible oscillations and chattering, so that the two tongues during chattering do not simultaneously interrupt the electrical contact in all probability. In effect, the entire bounce time is then determined by the chattering behavior of that tongue which chatters less. With this arrangement, however, it will be understood that when the elastic bending characteristics of the tongues are determined in the relaxed state for proper operation when assembled, the difference in length of the free springs must be taken into account.

It is also to be noted that the advantage of having different chattering behaviors for the tongues can also be produced by using tongues which have different thicknesses and/or widths.

Particularly for miniaturized double-throw contact assemblies, it has been found suitable to use contact arms which are stamped from a single sheet of metal, one portion consisting of a springy material and serving as a contact tongue, and another portion which is relatively easily bendable and which serves as a soldering terminal. In this manner, an advantage is realized that the portion of the contact arm which makes electrical contact consists of, for example, a leaf spring material which has been given maximum spring properties by harding, while the remaining portion of the contact arm that serves as a soldering terminal can be easily bent after harding of the spring material and after installation and adjustment of the individual contacts. Preferably, the contact arms are made of a leaf-like, so-called duometal, so that the spring material consists of copper-beryllium bronze and the relatively easily bendable material consists of brass.

BRIEF DESCRIPTION OF THE DRAWINGS

The invention will now be described in detail with reference to the accompanying drawings representing preferred embodiments of the double-throw contact assembly according to the present invention. In the drawings.

DESCRIPTION OF THE PREFERRED EMBODIMENTS

Figure 1:
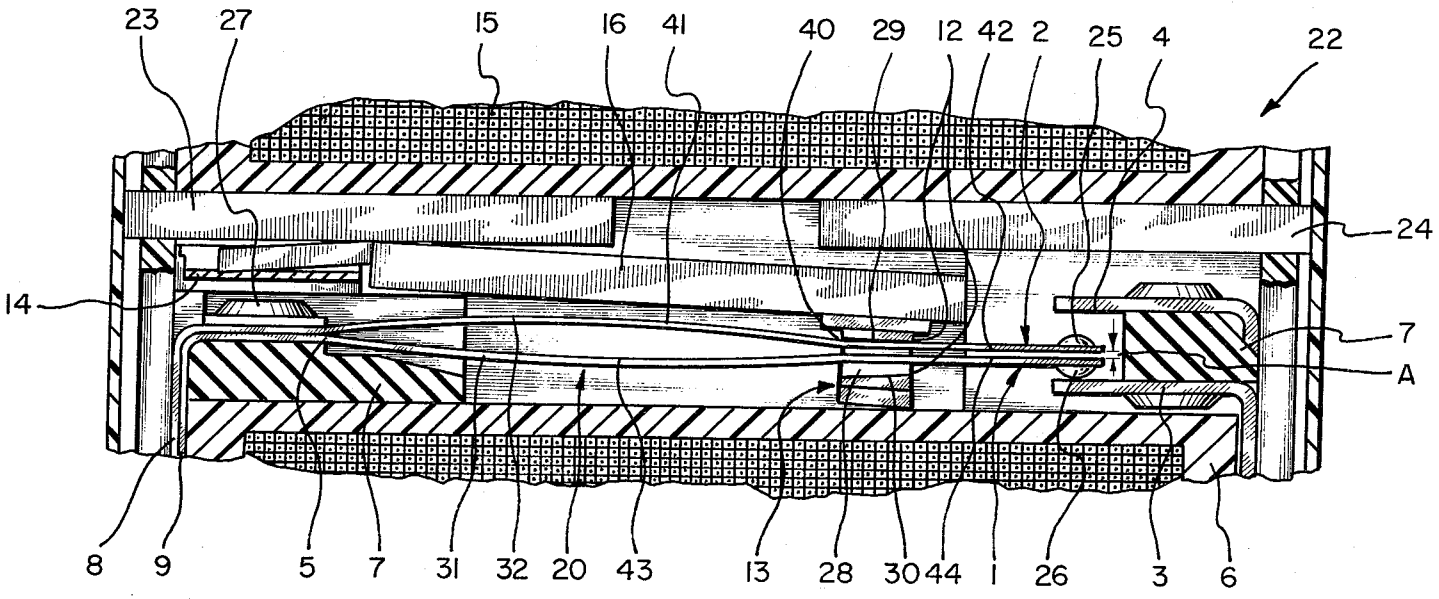
FIG. 1 is a cross sectional view of a miniaturized relay having a double-throw contact assembly in accordance with the invention.

In FIG. 1, there is illustrated a relay shown generally at 22 and including a coil form 6 upon which a winding 15 is disposed. In the coil form 6, there are shown two pole pieces 23 and 24 extending in the longitudinal direction of the coil.

A common insulating body 7 is provided for mounting the various parts of the contact assembly, and as seen in FIG. 1, secured to the insulating body 7 are break contact 3, make contact 4, and double-throw contact arms generally shown at 20, the latter being secured to the insulating body means of fastener means 27. The double-throw contact arms 20 consists of two leaf-shaped contact arms 31, 32 which carry contact points 25 and 26, respectively, at their free ends that face the break and make contacts 3 and 4, respectively. The two contact arms 31 and 32 are clamped at clamp point 5, and are bent at right angles at their fixed ends with respect to the longitudinal axis of the coil form 6, the extreme ends of the contact arms 31 and 32 beyond the contact point 5 thus forming soldering terminals 8 and 9 for the relay.

The relay 22 is illustrated in its deenergized state where the armature 16 has fallen away from engagement with pole piece 24. In the deenergized state the armature is brought into the position shown in FIG. 1 by the armature return spring 14. At the tiltable end (adjacent pole piece 24) of the armature 16, there is secured an actuator 13 which is provided in the form of a U-shaped opening 28 extending substantially normal to the longitudinal direction of the coil form 6 and having the facing inner surfaces 29 and 30 thereof encompassing the two contact arms 31 and 32. As shown in FIG. 1, the inner surface 29 of the top leg of the U-shaped opening has been effective to push away contact point 25 from make contact 4, but not to the extent that the two contact arms 31 and 32 touch. It should be additionally noted that the bottom inner surface 30 is spaced from the lower contact arm 31 in the deenergized state of the relay 22.

Figure 2:
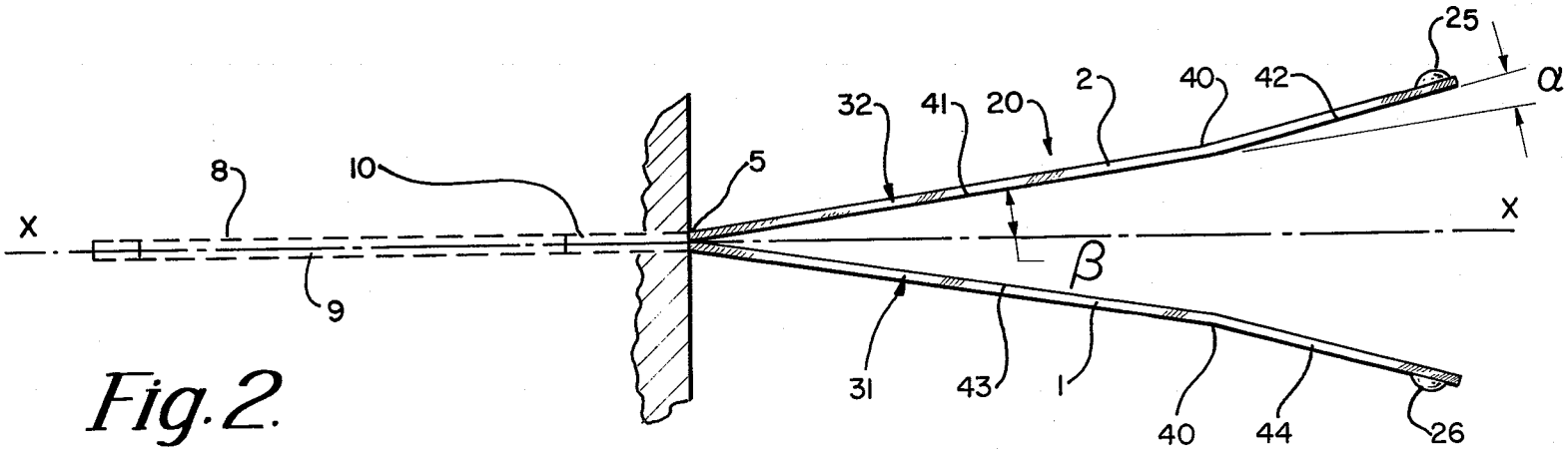
FIG. 2 is a side elevation view of a pair of contact arms for the double-throw contact assembly in accordance with the invention, the arms being in their relaxed state.
Figure 4:
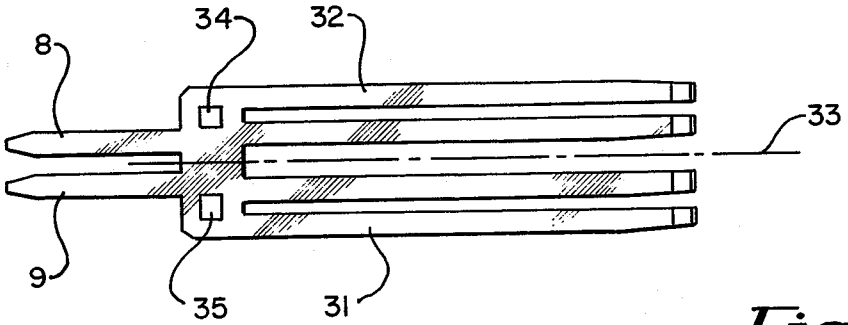
FIG. 4 is a plan view of the double-throw contact arms of FIGS. 2 and 3 prior to forming the contact arms in their final configurations.
Figure 3:
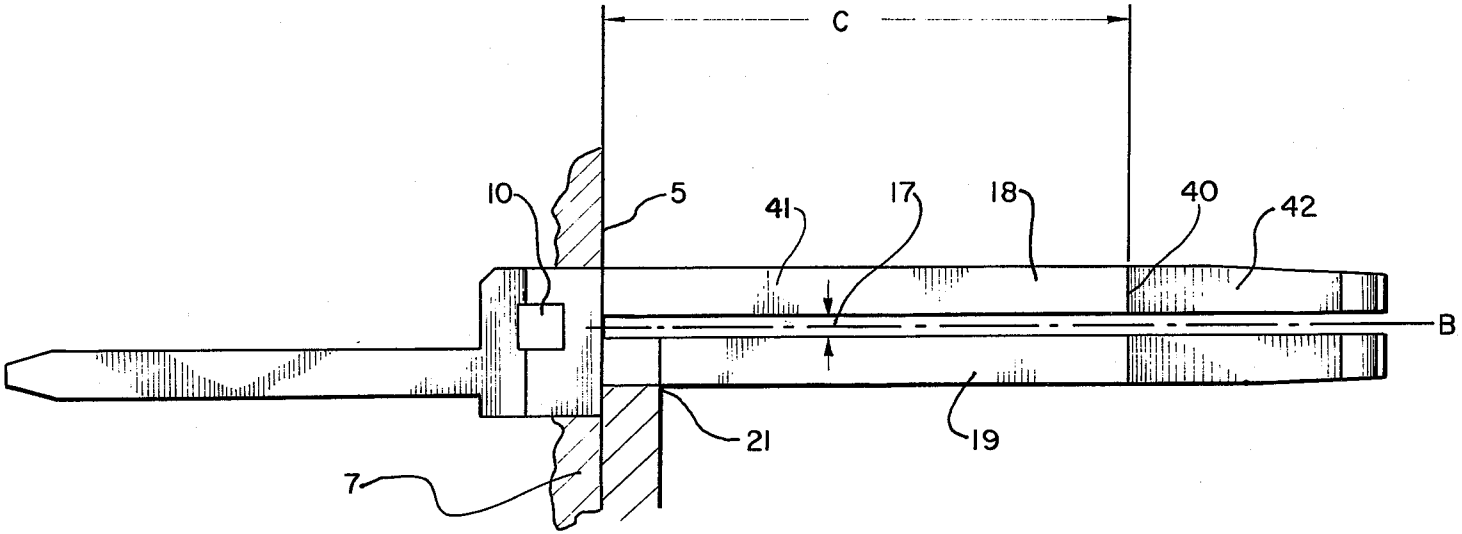
FIG. 3 is a top plan view of the double-throw contact of FIG. 2, but showing, in addition a separate clamp point for one of the tongues.

The form of the double-throw contact arm arrangement, and particularly of the contact arms 31 and 32, is shown in more detail in FIGS. 2–4. As will be evident from FIG. 4, the contact arms 31 and 32 are made of a unitary leaf spring material, for example by stamping, and they are connected to each other along a symmetrical line 33. It will be understood that the contact arms can also be made as separate parts with different shapes. The two contact arms 31 and 32 are folded against each other about the symmetrical line 33 so that the cutouts 34 and 35 are in alignment and produce a fastener opening 10 as illustrated in FIG. 3.

The two contact arms 31 and 32 may be made of a uniform material, for example, of a leaf spring material. Preferably, however, a strip-like duo-metal having a first portion of springy material such as copper beryllium bronze and a second portion consisting of an easily bendable material such as brass, is beneficially utilized. The duo-metal arrangement may be such that the transition point between the two different metals is approximately in the region of the fastener opening 10, so that the ends of the contact arms carrying the contact point 25, 26 are in form leaf springs 1 and 2, while the soldering terminals 8 and 9 are formed of the easily bendable portion of the material. Such a duo-metal is readily available in the trade, and there is therefore no further description provided herein.

As shown in FIG. 2, the leaf springs 1 and 2 in their relaxed state are bent outwardly from the symmetrical line X in opposite directions. Each of the two leaf springs 1 and 2 have two straight sections 41, 42 and 43, 44 respectively, the two straight sections separated by a bend 40. The first portion 41 is bent at an angle $\beta$ from tye symmetrical line X, and the portion 42 is bent with respect to portion 41 by an angle $\alpha$ about the bend 40.

As illustrated in FIG. 3, the bend line 40 is situated between the portions 41 and 42 at a distance C from the clamp point 5. The positioning of bend 40 is preferably such that the ratio of the lengths of portions 41 and 43 to the lengths of the portions 42 and 44 is approximately two to one. The angle $\beta$ by which the section 41 or 43 is bent with respect to the symmetrical line X should be between about 7° and 11°, and is preferably 9°. The angle $\alpha$ by which the portion 42 or 44 is bent with respect to the portion 41 or 43, respectively, should be between 2° and 4°, and is preferably 3°.

As shown in FIG. 1, the actuator member 13 provided on the armature 16 is so arranged that the point of engagement 12 with the contact arms 31 and 32 is between the bend 40 and contact points 25 and 26. Preferably, the point of engagement 12 is immediately adjacent the bend 40. Such positioning of the engagement point 12 with respect to the bend 40 makes it possible that in the tensioned state, the portions 42 and 44 of contact arms 32 and 31, respectively, are disposed essentially parallel to the axis of the coil form 6 and are separated a small distance A from each other. The distance A serves to eliminate any physical coupling between the contact arms 31 and 32 in either the energized or deenergized condition of the relay, and thereby minimizes chattering of the closed set of contacts. The distance A can be kept relatively small, thereby permitting a reasonably small distance to exist between the make contact 3 and break contact 4 sufficient for incorporation in a miniaturized relay.

As further shown in FIG. 1, portions 41 and 43 in their tensioned (assembled) state causes contact arms 31 and 32 to bulge outwardly. The particular form taken on by the bulged arms 31 and 32 is not critical for reliable operation of the relay, since the movement and spacing of the contact points with respect to the break and make contacts are not influenced thereby.

To install the contact assembly within the core of relay 22, the make and break contacts, as well as the double-throw contact arms 20, are first secured a common insulating body 7 which is then introduced from the right-hand side in FIG. 1 into the center of coil form 6. Then, due to the fact that the soldering terminals 8 and 9 consist of a soft bendable material, the soldering terminals 8 and 9 can be easily bent without causing damage to the remainder of the assembly or causing a change in the contact forces at the contact points.

The operation of an assembled relay 22 is as follows:

In the embodiment illustrated in FIG. 1, the relay 22 is in the deenergized state. In this state, the lower leaf spring 1 is positioned with its straight section 44 substantially parallel to the longitudinal axis of the relay, with contact point 26 bearing against break contact 3, while the inner surface 29 of U-shaped opening 28 of actuator 13 holds the upper leaf spring 2 out of engagement with the make contact 4. In this position, the portion 42 of the upper leaf spring 1 remains straight, because the point of engagement 12 of the actuator 13 is between bend 40 and the contact point 25 adjacent bend 40. Further, portion 42 is spaced a distance A from the corresponding section 44 of contact arm 31. The portion 41 has a convex shape similar to that of section 43 between the clamp point 5 and bend 40.

If the relay 22 is now energized, the armature 16 is attracted toward pole piece 24, thereby freeing the upper leaf spring 2 so that it is allowed to bear against the make contact 4 at contact point 25 due to its being confined between the make and break contact in a tensioned state. At the same time, the lower inner surface 30 of the opening 28 now bears against the lower leaf spring 1 at the point of engagement 12 and lifts it, against its spring biasing force, from the break contact 3. The opening 28 is selected to be such that the lifting of the contact point 26 from break contact 3 takes place before the contact point 25 makes contact with the make contact 4. This break-before-make sequence is also realized when the relay switches from the energized to the deenergized state. Of course, a reliable make-before-break sequence could be achieved if desired, by enlarging the size of the opening 28 or decreasing the spacing between contacts 3 and 4.

When the relay is again deenergized, the armature 16 is returned to its original position by means of the armature return spring 14, whereby the lower leaf spring 1, together with the lower inner surface 30 of opening 28 moves downwardly, while the upper inner surface 29 pushes the upper leaf spring 2 away from make contact 4. In the deactivated state of the relay, the actuator 13 is positioned downwardly such that the lower inner surface 30 is completely disengaged from leaf spring 1 to permit the spring 1 to make contact at contact point 26 with break contact 3. It will be noted that with this arrangement, in the deenergized state of the relay, there is no physical coupling between armature 13 and leaf spring 1 so that a transmission of chattering motion of the armature upon the contacting leaf spring is avoided. The same is true in the energized state of the relay, as can be appreciated by the above discussion of the energized state of the relay.

As shown in FIG. 3, the two leaf springs 1 and 2 are cut from their free ends toward clamp point 5 defining a slot 17 of predetermined width. This slit 17 is arranged such that it forms two tongues 18 and 19 symmetrically disposed about the line of symmetry D. By slitting the contact arm in this manner, the reliability of contact at the respective contact points is improved. At the same time, chattering behavior of each arm can be improved by making the free length of each tongue different. This is accomplished by providing an extension 21 on the insulating body 7 which is disposed longitudinally of the line of symmetry B directly beneath and adjacent to the fixed end of the tongues 19. In this manner, the probability that the two tongues 18 and 19 will simultaneously interrupt the contact during chattering is decreased.

It will be appreciated that the advantage of a difference in chattering behavior of the two tongues 18 and 19 can also be achieved by providing the tongues with different thicknesses or widths, and can also be accomplished by forming each tongue into a different (for example) trapezoidal shape.

In a preferred embodiment, the length of sections 41 and 43 is 8.5 mm. while the portions 42 and 44 have a length of approximately 4.3 mm. The angle $\beta$ is preferably 9°, and the angle $\alpha$ is approximately 3°. The point of engagement 12 of actuator 13 is between bend 40 and contacts 25 and 26 at a distance of approximately 1.2 mm from bend 40.

Figure 5:
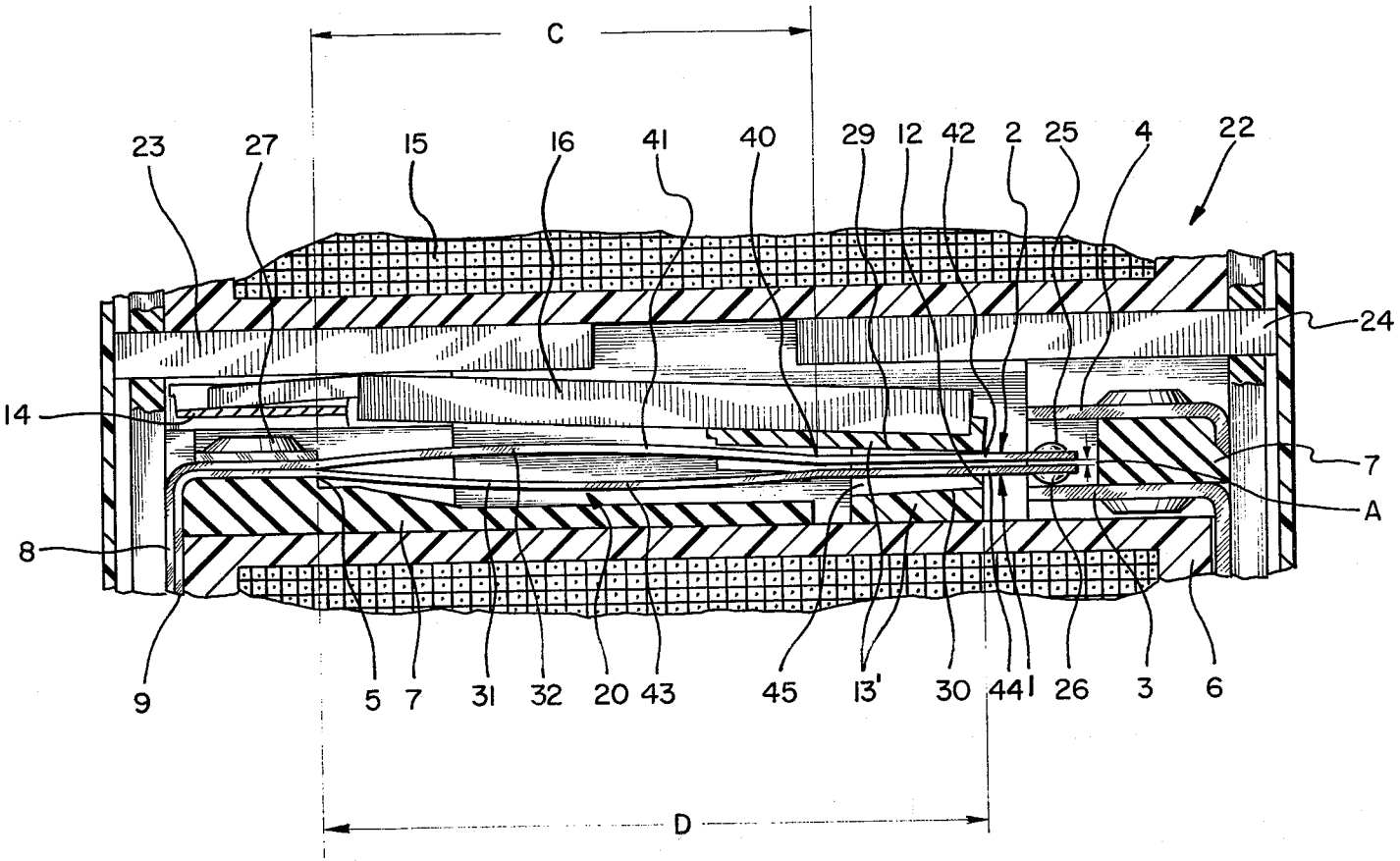
FIG. 5 is a cross-sectional view of a miniaturized relay containing a double-throw contact assembly in accordance with a second embodiment of the invention.

FIG. 5 illustrates an alternative embodiment of the invention wherein a miniaturized relay similar to that shown in FIG. 1 has a distinguishing arrangement insofar as the actuating member 13 is concerned. In FIG. 5, reference numerals are provided similar to the reference numerals in the embodiment according to FIG. 1.

In FIG. 5, the actuator 13' has the shape of a frame member having an opening 45 through which the two contact arms 31 and 32 extend. Frame 13' is preferably divided along a vertical plane into two frame compartments. The vertical plane may, for example be situated along the line of symmetry B shown in FIG. 3, that is between the tongues 18 and 19 of the same contact arm, which tongues are separated by slit 17. In this manner, the actuator 13' demonstrates a greater stiffness and stability. In the embodiment shown in FIG. 5, the actuator 13' engages sections 42 or 44 at a greater distance from the bend line 40. For this embodiment, the distance C between the clamp point 5 and bend line 40 is 8.5mm, while the distance D between the clamp point 5 and the point of engagement 12 of the actuator 13' is 11.2mm.

What is claimed is:

1. In a double-throw contact assembly for an electrical switching device including first and second fixed contact members disposed in opposed, spaced-apart relation to each other, a movable contact element for making contact alternatively with said first or second fixed contact member, said movable contact element comprising two flexible contact arms, each said arm having a contacting surface at one free end thereof with the other end of each said contact arm being affixed to a fixed clamp support so that said contacting surface is disposed within the space between said first and second fixed contact members, and actuating means for moving said movable contact element, including a member engageable with said contact arms, the improvement wherein each said contact arm comprises:

a fixed arm portion secured against movement by said clamp support between the fixed end of said contact arm and a clamp point spaced from said fixed end along the length of said contact arm, and a movable arm portion extending from said clamp point to the free end of said contact arm, said movable arm portion including said contacting surface at the free end thereof movable into and out of engagement with one of said fixed contact members, each said movable arm portion of each said two contact arms including a single bend disposed along its length intermediate said free end and said clamp point to define for each said movable arm portion when in a relaxed state a first straight portion extending angularly from said fixed arm portion at said clamp point to said bend, and a second straight portion extending angularly from said first straight portion at said bend to the free end of said contact arm, the movable arm portions of said two contact arms diverging outwardly from a common line of symmetry directed longitudinally of said contact arms when in a relaxed state, the engaging member of said actuating means placing at least one of said movable arm portions in a tensed state by engaging the second straight portion thereof whereby said second straight portions of the two movable arm portions are maintained in a spaced-apart, substantially parallel relation between said bends and said free ends while the first straight portions of said two movable arm portions are maintained in an opposed, substantially convex relation between said clamp points and said bends when both said movable arm portions are in a tensed state within said contact assembly.

2. The improvement as claimed in claim 1, wherein the angle between respective second straight portions of said movable arm portions of said two contact arms in their relaxed state is greater than that between respective first straight portions thereof.

3. The improvement as claimed in claim 1, wherein the ratio of the lengths of said first straight portion to said second straight portion of each said movable arm portion is approximately two to one.

4. The improvement as claimed in claim 1, wherein said first straight portion of each said movable arm portion in its relaxed state forms, at said clamp point, an angle of approximately 9° with a line of symmetry directed longitudinally of said fixed arm portion.

5. The improvement as claimed in claim 1, wherein said second straight portion of each said movable arm portion in its relaxed state forms, with respect to the angle of orientation of said first straight portion, an angle of approximately 3°.

6. The improvement as claimed in claim 1, wherein said engaging member comprises an actuator member, said movable arm portions of said contact arms being restrained from moving to their relaxed state in one direction by said actuator member and in an opposite direction by one of said fixed contact members to define said tensioned state for said movable arm portions of said contact arms within said contact assembly.

7. The improvement as claimed in claim 6, wherein said actuator member has an opening defined in part by opposite inner surfaces and through which said second straight portions of said contact arms extend, each of the opposite inner surfaces of said opening being engageable with the movable arm portion adjacent thereto in order to alternately move said movable arm portions out of contact with their associated fixed contact members, each said opposite inner surface being engageable with the adjacent movable arm portion along its second straight portion and adjacent its bend.

8. The improvement as claimed in claim I, wherein said contact arms are leaf shaped and are held along their fixed arm portions so as to touch each other therealong.

9. The improvement as claimed in claim 1, wherein said contact arms are formed of a connected piece of material.

10. The improvement as claimed in claim 9, wherein said contact arms are formed in a connected sheet of material which is folded against itself along a line parallel to the length of said contact arms.

11. The improvement as claimed in claim 7, wherein: said actuator member is movable to two operating positions; and said opening in said actuator member is sized such that said second straight portions of said contact arms have a predetermined minimum distance therebetween in the tensioned state of said arms when said actuator member is in either of its two operating positions.

12. The improvement as claimed in claim 8, wherein said movable arm portion of each said contact arm is slit along the length thereof to form individual tongues extending from said free end to said clamp point.

13. The improvement as claimed in claim 12, wherein each of said tongues has a separate clamp point, the clamp points being displaced with respect to each other in the longitudinal direction of the contact arm.

14. The improvement as claimed in claim 1, wherein said second straight portions of said movable arm portions of said two contact arms have different thicknesses.

15. The improvement as claimed in claim 1, wherein said second straight portions of said movable contact portions of said two contact arms have different widths.

16. The improvement as claimed in claim 1, wherein said contact surfaces at the free ends of said contact arms are formed by a double noble metal strip welded upon said contact arms.

17. The improvement as claimed in claim 1, wherein said fixed arm portions of said contact arms include a terminal portion, each contact arm consisting of a single piece having its movable arm portion made of a springy material and said terminal portion made of a material which can be bent relatively easily and which serves as a soldering terminal.

18. The improvement as claimed in claim 17, wherein said contact arms consist of a sheet-like duo-metal.

19. The improvement as claimed in claim 17, wherein said springy material consists of a copper-beryllium bronze.

20. The improvement as claimed in claim 17, wherein the material which is relatively easily bendable is brass.

* * * * *